United States Patent [19]

Arzberger et al.

[11] Patent Number: 4,934,978

[45] Date of Patent: Jun. 19, 1990

[54] ROTATION-ELASTIC DAMPED CUTTING DEVICE

[75] Inventors: Maximilain Arzberger, Ig enhausen; Johann Haberer, Schrobenhausen, both of Fed. Rep. of Germany

[73] Assignee: Bauer Spezialtiefbau GmbH, Schrobenhausen, Fed. Rep. of Germany

[21] Appl. No.: 236,852

[22] Filed: Aug. 26, 1988

[30] Foreign Application Priority Data

Aug. 28, 1987 [DE] Fed. Rep. of Germany ..... 3728866

[51] Int. Cl.[5] ..... F16D 3/50

[52] U.S. Cl. ..... 464/96; 464/89

[58] Field of Search ..... 464/89, 90, 91, 180, 464/92, 96; 175/91, 96

[56] References Cited

U.S. PATENT DOCUMENTS

| | | | |
|---|---|---|---|
| 1,868,818 | 7/1932 | Eksergian | 464/90 |
| 2,262,512 | 11/1941 | Musselman | 464/89 |
| 2,880,599 | 4/1959 | Hlinsky | 464/89 |
| 2,956,187 | 10/1960 | Wood | 464/89 X |
| 3,304,747 | 2/1967 | Elenburg | 464/89 |
| 4,041,730 | 8/1977 | Kress | 464/89 X |
| 4,467,753 | 8/1984 | Lange | 464/89 X |

FOREIGN PATENT DOCUMENTS

| | | | |
|---|---|---|---|
| 200934 | 12/1958 | Austria | 464/91 |

*Primary Examiner*—Daniel P. Stodola

*Attorney, Agent, or Firm*—Fleit, Jacobson, Cohn, Price, Holman & Stern

[57] ABSTRACT

A slitting cutter with at least one drive unit which, by a cutting wheel gear, drives the driven shaft of the cutting wheels equipped with cutting teeth. Although optionally hitherto a clutch has been provided between the driving unit and the actual cutting wheel gear, abrupt blocking of jamming processes on the cutting teeth seriously stressed the cutting wheel gear. This is now inventively prevented in that a rotation-elastic damping member is provided gradually between the driven shaft and the particular cutting wheel.

3 Claims, 4 Drawing Sheets

ROTATION-ELASTIC DAMPED CUTTING DEVICE

BACKGROUND OF THE INVENTION

The present invention relates to a slitting cutter with at least one drive unit.

Such a slitting cutter is e.g. known from DE-OS No. 34 24 999. The aim of this known slitting cutter is to bring about a very simple but functional force transmission from the corresponding drive unit to the cutting wheels. Force transmission by means of bevel and planetary gears, as well as by means of a simple chain drive is described.

It is possible to fit a clutch between the drive unit and the cutting wheel gear in the case of such slitting cutters. This virtually corresponds to standard practice in machine building for switching corresponding starting and disconnection processes, as well as the desired power transmission to the cutting wheels.

However, it has been found that particularly under the difficult conditions of use and ground structures where slitting cutters are mainly used, serious damage occurs to the cutting wheel gear. Damage is particularly due to the fact that the cutting wheels during the cutting process suddenly strike against hard materials, such as rubble, boulders, concrete residues and the like, so that there is often an abrupt blocking of the cutting wheels. As a result of the abrupt blocking of the cutting wheels, these forces must be absorbed in shock-like manner by the cutting wheel gear, so that the latter is overstressed and is therefore exposed to considerable wear. This means that after virtually every usage of said slitting cutters, the cutting wheel gear has to be dismantled and at least maintained, if not replaced.

SUMMARY OF THE INVENTION

The problem of the present invention is to design in a robust and functionally simple manner a slitting cutter of the aforementioned type in such a way that sudden stresses to the cutting wheel gear both during the jamming of the cutting wheels and during the starting and disconnection phase are largely avoided and at least are considerably reduced.

Thus, it is a basic idea of the invention to so-to-speak "integrate" directly into the cutting wheels a damping means in addition to a clutch provided between the drive unit, e.g. a hydraulic motor and the cutting wheel gear. Thus, in radial spacing with respect to the driven shaft is provided a rotation-elastic damping member, preferably made from a highly elastic natural rubber, which, considered radially, is positioned close to the circumferential surface of the cutting wheels. In the case of a sudden stopping of the cutting wheels, e.g. due to a catching of the cutting teeth on a boulder, said elastomeric damping member can at least considerably damp or attenuate the high and suddenly occurring torque, so that virtually no shock-like loading of the cutting wheels is transferred to the cutting wheel gear. This damping is firstly brought about by the high elasticity of the damping member, which allows a considerable turning of the adjacent circular parts. In addition, part of the torque occurring in such blocking or jamming cases is destroyed by the shape change work in the elastomer.

The delay brought about by the damping member during the transfer and damping of the sudden loading on the cutting wheel gear, also makes it possible to disengage the power from the drive unit, so that a permanent loading in the rotation direction with the cutting wheels jammed is avoided. The elastomeric material of the damping member must therefore be chosen with a high shear strength, this also applying with respect to the vulcanizing on and in process with respect to the adjacent metal sleeves.

A particular advantage of the invention is that it is possible to retain the basic construction between the cutting wheel gear and the cutting wheels. In fact, this construction must be retained and consequently a solution dependent thereon must be found. The inventive measure that the elastomeric damping member has a maximum diameter and minimum spacing from the circumferential surface of the cutting wheel about the driven shaft means that the hitherto used cutting wheel construction can be left virtually unchanged. As the damping member is directly exposed to the corresponding ground conditions and had to be adapted to the robust construction of the slitting cutter, it has been designed with a relatively small radial thickness. However, in order to be able to damp or absorb the high torques which occur and which can, e.g., be 30 kNm per cutting wheel set in extreme cases, every effort is made to give the sleeve-like damping member a maximum circumferential circle.

Despite constricted space conditions between the cutting wheel gear and the actual cutting wheel, a damping of shock-loads is possible, so that through the time lag it is also possible to switch off the drive unit, e.g., a hydraulic motor as result of an overpressure which is building up.

Advantageously the damping member is designed as a cylindrical bush, which is vulcanized on or in between the inner hub ring connected to the driven shaft and an outer metal sleeve The damping member, including the inner hub ring and radially outer metal sleeve or sheet metal segment is designed as a subassembly, so that there can be a relatively simple and complete replacement of the damping unit.

The radially outer metal sleeve of the damping unit is connected in substantially non-rotary manner to the cutting wheel by means of key and slot connections, which are distributed circumferentially with the same angular spacing. In order to ensure good accessibility the non-rotary connections between the driven shaft on the one hand and between the damping unit and the cutting wheel on the other comprise axial screw connections, which are accessible from the end face of the driven shaft.

As the cutting wheels are conventionally axially designed with two or three cutting tooth sets, the bush-like damping member largely extends over the entire axial extension of the cutting wheel, so that different forces acting radially from the cutting teeth onto the driven shaft can be absorbed and transferred over a larger axial surface.

The radial thickness of the damping member can, e.g., be approximately 3 cm in the case of an inner radius in the fitted state of 50 cm, whereby the outer surface of the cutting wheel can have a radius of approximately 65 cm. The outer surface of the cutting wheel is so understood in this case that the corresponding fixing means for the cutting teeth are fitted and in particular welded thereto. It is particularly preferred for the damping member, to the extent that this is possible, to be radially outwardly displaced towards the cutting wheel circumference. The metal sleeve can, e.g., comprise four sheet metal segments between which there are corresponding slots which positively and non-positively engage the keys of the cutting wheel.

BRIEF DESCRIPTION OF THE DRAWINGS

The invention is described in greater detail hereinafter relative to a non-limitative embodiment and the attached drawings, which show.

DETAILED DESCRIPTION OF THE PREFERRED EMBODIMENTS.

Figure 1:
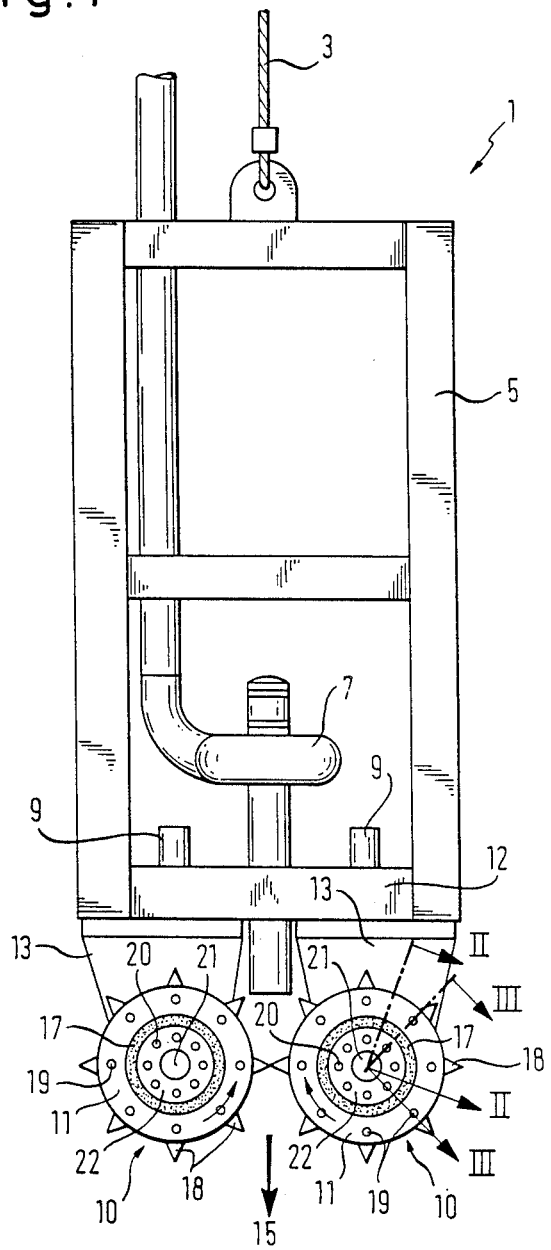
FIG. 1 a side view of a slitting cutter with frontally represented cutting wheels.

FIG. 1 is a side view of a slitting cutter 1, as is fundamentally known from DE-OS No. 34 24 999. The slitting cutter 1 has a support frame 5, which is held by a support cable 3. There is a suction device with pump 7 by means of which the detached ground material is conveyed upwards. There are also drive motors 9 for the cutting wheels 11 fixed to the support frame 5, which drive the cutting wheels 11 by means of the diagrammatically indicated gear 12. The two represented cutting wheels 11 are received in rotary manner in two bearing brackets 13, which are once again fixed to the cutting or support frame 5. In the case of use, the slitting cutter 1 is advanced in accordance with arrow 15. Conventionally on the other side of the bearing brackets 13, the slitting cutter 1 also has two cutting wheels. On its circumferential surface the cutting wheel 11 normally has several cutting tooth sets 10, which are arranged in axial succession on the driven shaft. The cutting tooth sets 10 are generally displaced somewhat in the rotation direction, so that in angularly displaced manner the corresponding cutting teeth 18 carry out the cutting process.

Unlike in the case of the slitting cutter 1 known from DE-OS No. 34 24 999, the cutting wheels 11 shown in FIG. 1 are provided with an elastomeric damping member 17, which is vulcanized with radial spacing about the driven shaft 21 on a corresponding hub ring 22.

Figure 2:
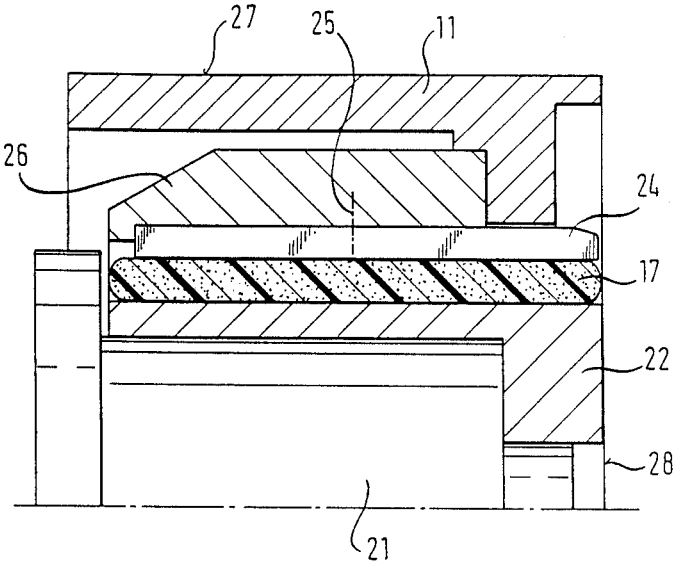
FIG. 2 a radial section through a cutting wheel without cutting teeth in the vicinity of a key and slot connection along line II—II with the damping member and the driven shaft.
Figure 3:
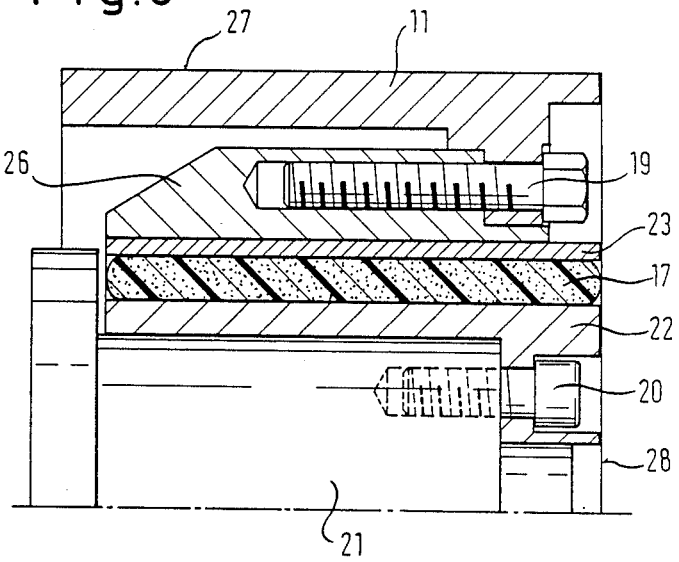
FIG. 3 a radial section comparable with FIG. 2, but in the vicinity of the axial screw connections between the cutting wheel and driven shaft along line III—III.

With reference to FIGS. 2 and 3, the damping member 17 is radially outwardly surrounded by sheet metal segments 23, which can also be designed as a metal sleeve. In practice four sheet metal segments 23 are sufficient and they are spaced from one another circumferentially over a corresponding slot. In accordance with FIG. 2, a corresponding key 24 engages in said slot and it is connected at 25 to an outer hub part 26 or a sleeve-like cutting wheel 11.

The damping member 17 which is e.g. made from an elastomer with a Shore A rubber hardness of approximately 55 and a tensile strength of approximately 15 to 30 $N/mm^2$ is firmly vulcanized in between the inner hub ring 22 and the radially outer sheet metal segments 23. Whilst the hub ring is connected in non-rotary manner to the driven shaft 21 by means of screws 20, the sheet metal segments 23 are positively connected in non-rotary manner to an outer hub part 26 by means of keys 24 (FIG. 2). The fixing of said hub part 26 takes place from the front of the driven shaft 21 by means of expansion bolts 19 which engage with the cutting wheel 11.

The driven shaft 21 is shown diagrammatically and not with its realistic diameter in the drawings. In practice, the driven shaft diameter would be much larger than in the drawings. However, the construction is such that the screw connections 20,19 can be released from the face 28 and it is also possible to disassemble in this direction the complete subassembly of damping unit 17, 22, 23. The cutting wheels 11 are shown in FIGS. 2 and 3 without the fixing means and cutting teeth welded to the circumferential surface 27. Normally there are several cutting tooth sets 10 in the axial direction on the circumferential surface 27 of cutting wheels 11.

In the case of an abrupt stoppage and jamming of the cutting wheels 11 in the rotation direction of the drawn in arrows, (FIG. 1), the torque resulting from the driven shaft 21 is circumferentially absorbed in the damping member 17, or is at least damped to such an extent that there is no shock-like stressing of the not shown cutting wheel gear following the said shaft 21 in the direction of motor 9. The vulcanizing on of damping member 17 is such that the deformation forces and shear forces which occur lead to no breaking away of the vulcanization joint between hub 22 and sheet metal segments 23.

Figure 4:
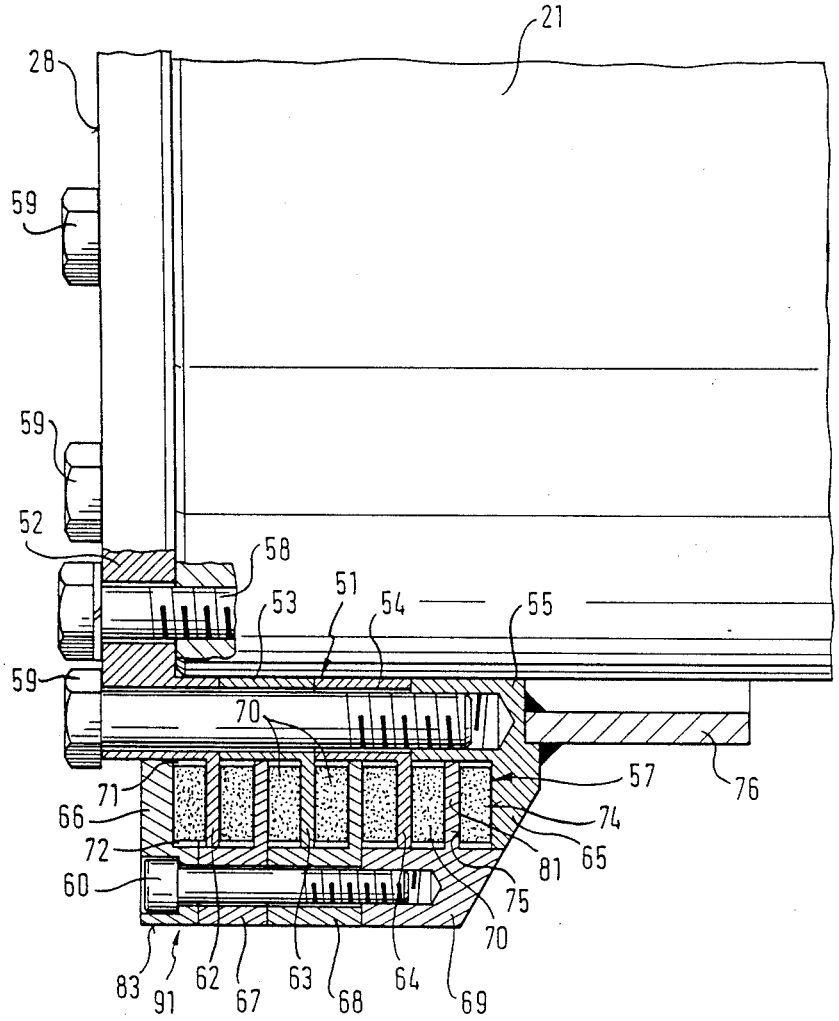
FIG. 4 another alternative of the damping member in a fragmentary radial section through a cutting wheel, the cutting teeth having been omitted for simplification purposes.

In the further embodiment of the damping member according to FIG. 4, the lower part of the cutting wheel 21 is shown in fragmentary manner in a radial section. The basic difference between the previously described first embodiment is that the second alternative relates to a lamellar stringing together of individual elastomeric elements 70 with alternating metal rings 62 to 65. The fundamental construction of this second alternative of the slitting cutter with damping member 57 comprises fixing a segmented hub ring 51 in the frontal marginal area of the driven shaft 21 by means of expansion bolts 58. Hub ring 51 has a first, frontal segment 52, which covers the corner region of the driven shaft 21. Segment 52 has a radial ring segment 62 which is axially set back with respect to the front face and which has a reduced material thickness in the axially parallel direction.

In assembly-reverse order, further segments 53,54,55 are screwed together by means of a screw 59. These segments 53 to 55 have in each case radially projecting ring segments 63,64,65.

The axially innermost segment 55 is welded to a spacer tube 76, which extends in axially parallel manner on the outer circumference of driven shaft 21, there being a symmetrical arrangement of a hub ring with damping member on the not shown face of the driven shaft 21.

The elastomer rings 70 are surface fixed by means of an adhesive joint to the radial ring surfaces 74 of the radial ring segment 62 to 65 in the present embodiment. The adhesive is e.g. constituted by a one-component adhesive or preferably the adhesive Loctite IS 496. In radial section, the elastomer ring 70 have a roughly elongated-rectangular shape. The mating surface of the axially innermost elastomer ring 70 is formed by the bonding surface 75 of a metal ring web 81 projecting from the outside radially inwards. This metal ring web 81 is part of an outer ring segment 69.

In a similar manner to what has been described hereinbefore in connection with hub ring 51, the outer region of the cutting wheel is formed by external ring segments 66, 67, 68 and 69, which roughly have a L-shape. In the base leg, these ring segments 66 to 69 are held together in the axially parallel direction by a setscrew 60 and can also be pressed together. The radial, upright L-legs engage in tooth-like manner in the gaps between the radial ring segments 62 to 65, the spaces formed between the corresponding inner radial ring segments 62 to 66 and the outer L-legs being occupied by individual elastomer rings 70. These elastomer rings are bonded at the radial surface with the engaging radial metal surfaces, but for an axial parallel pressing, e.g. by setscrew 60, there is a minimum radial spacing 71, 72 towards the outside and inside on elastomer ring 70.

Thus, in the second embodiment the damping member 57 is like a "multiple-disk clutch", the corresponding damping forces being substantially absorbed on the radial surfaces and in the elastomer ring 70 in the radial direction.

The cutting teeth, which in the embodiment according to FIG. 4 are not shown, are e.g. welded to the radial circumferential surface 83. The welded fixture preferably takes place over the entire axial extension of the circumferential surface 83, so that the force transfer can take place over all the segments and elastomer rings 70.

Figure 5:
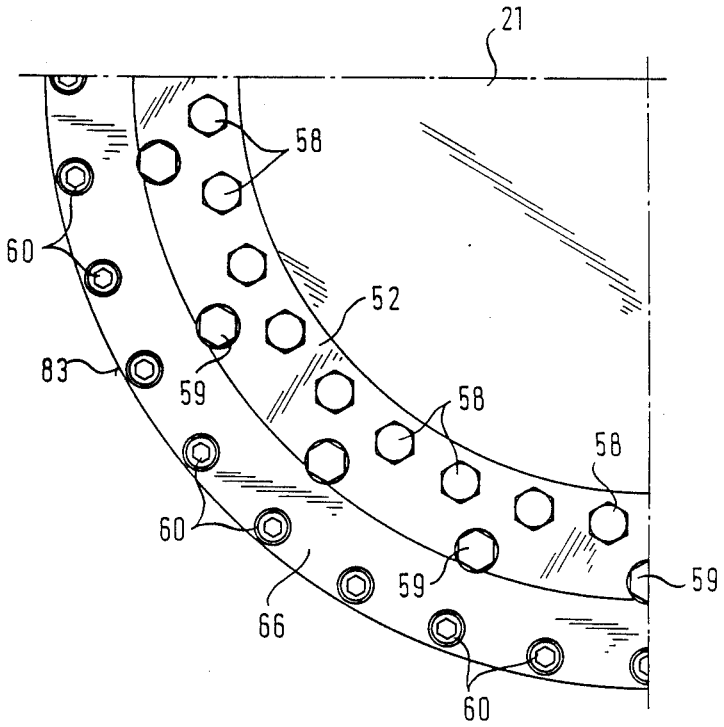
FIG. 5 a front view of the fragmentary part according to FIG. 4.

In the case of an abrupt jamming of a cutting tooth 18 with respect to the driven shaft 21, shear and deformation forces are absorbed in the elastomer rings 70, so that the abrupt force action through jamming is only transferred in greatly reduced manner to the driven shaft 21. FIG. 5 shows the example according to FIG. 4 towards end face 28 in a circumferential range of 90°. It can be seen that the radially inner expansion bolts 58 are used for joining the hub ring 51 to the driven shaft 21. The setscrews 60 are located on the radial outside, whilst in the central region the screws 59 are shown for fixing segments 52 to 55 of hub ring 51.

Thus, according to the invention, despite constricted space conditions and in a robust, simple manner a damping member is provided between the cutting wheels and the cutting wheel gear, which absorbs shock-like torques, e.g. caused by the jamming of the cutting wheels and therefore prevents damage to the cutting wheel gear following in the direction of the drive unit.

What is claimed is:

1. A rotation-elastic damped cutting device of a slitting cutter having drive means for driving a driven shaft of the cutting device by means of an upstream clutch and a cutting wheel gear, said rotation-elastic damped device comprising:

a cutting wheel having cutting teeth and external ring segments having an L-shape, first fastening means for axially pressing together said external ring segments, rotation-elastic damping means provided between the driven shaft and said cutting wheel for absorbing shock imparted to said cutting teeth, a segmented hub ring comprising axial segments being fixed to a frontal margin of the driven shaft, each segment including a radially projecting ring segment, second fastening means for fixing said axial segments to the frontal margin of the driven shaft, third fastening means for fixing said axial segments together, said damping means having a plurality of elastomer rings axially and radially fixed between said radially projecting ring segments and said external ring segments, said first, second and third fastening means being releasably fixed to a front face of the slitting cutter without penetrating said plurality of elastomer rings.

2. A rotation-elastic damped cutting device according to claim 1, wherein said elastomer rings include a minimal radial spacing for an axial pressing by said first fastening means.

3. A rotation-elastic damped cutting device according to claim 2, wherein said elastomer rings are bonded to said radially projected ring segments.

* * * * *